US005279354A

United States Patent [19]

Grove

[11] Patent Number: 5,279,354

[45] Date of Patent: Jan. 18, 1994

[54] METHOD OF CONTINUOUS CASTING WITH CHANGING OF SLAB WIDTH

[75] Inventor: John W. Grove, Seneca, Pa.

[73] Assignee: Acutus Industries, Inc., Pontiac, Mich.

[21] Appl. No.: 819,418

[22] Filed: Jan. 10, 1992

Related U.S. Application Data

[63] Continuation-in-part of Ser. No. 621,126, Nov. 30, 1990, abandoned.

[51] Int. Cl.[5] ..... B22D 11/04

[52] U.S. Cl. ..... 164/491; 164/418; 164/435

[58] Field of Search ..... 164/491, 436, 459, 418

[56] References Cited

U.S. PATENT DOCUMENTS

| | | | |
|---|---|---|---|
| 3,226,782 | 1/1966 | Schultz . | |
| 3,228,071 | 1/1966 | Schultz . | |
| 3,375,865 | 4/1968 | Boichenko et al. . | |
| 3,618,658 | 11/1971 | Gallucci . | |
| 3,662,814 | 5/1972 | Kipp et al. . | |
| 3,709,286 | 1/1973 | Bower, Jr. . | |
| 3,823,761 | 7/1974 | Bode, Jr. . | |
| 3,926,244 | 12/1975 | Meier et al. . | |
| 3,967,673 | 7/1976 | Bower, Jr. . | |
| 4,023,612 | 5/1977 | Jackson . | |
| 4,245,692 | 1/1981 | Hargassner et al. | 164/436 |
| 4,505,321 | 3/1985 | Zeller . | |
| 4,635,702 | 1/1987 | Kolakowski et al. . | |
| 4,651,802 | 3/1987 | Wrhen . | |
| 4,679,614 | 7/1987 | Grove . | |
| 4,716,955 | 1/1988 | Fastert | 164/418 X |
| 4,721,151 | 1/1988 | Streubel | 164/418 |
| 4,811,779 | 3/1989 | Streubel et al. | 164/418 |
| 4,834,167 | 5/1989 | Streubel | 164/418 |

FOREIGN PATENT DOCUMENTS

| | | | |
|---|---|---|---|
| 887990 | 8/1953 | Fed. Rep. of Germany . | |
| 54-28227 | 3/1979 | Japan | 164/436 |
| 59-189047 | 10/1984 | Japan . | |

OTHER PUBLICATIONS

McManus, George J., "Steelmakers Pursue Thin Strip Casting", Iron Age, Aug., 1987, pp. 14-18.

"Hard Times In Steel? Not For Nucor", Iron Age, Aug., 1987, pp. 20-21.

"New SMS Technology For Thin Slab Casting", Iron And Steel Engineer, May, 1987 pp. 51-52.

*Primary Examiner*—J. Reed Batten, Jr.

*Attorney, Agent, or Firm*—Dykema Gossett

[57] ABSTRACT

A continuous casting mold for casting relatively thin slab comprises a pair of broad walls and a pair of narrow walls. The narrow walls are movable inwardly and outwardly with respect to the mold cavity to adjust the width of the slab being cast. The broad walls in an upper portion of the mold are spaced farther apart to permit introduction of molten metal into the mold. The broad walls in the lower portion of the mold are substantially parallel to each other. The narrow mold walls are adapted to sealingly engage the broad mold walls and are wider in the upper portion of the mold than in the lower portion. In one embodiment, a tilt angle of the lower portion of the narrow walls is independently adjustable from that of the upper portion of the narrow walls while in a second embodiment, each of the walls comprises independently angled top and bottom portions and provides a flat and smooth surface to the contained molten metal. Solidification in the upper portion of the mold is substantially prevented.

1 Claim, 3 Drawing Sheets

METHOD OF CONTINUOUS CASTING WITH CHANGING OF SLAB WIDTH

This is a continuation in part of U.S. patent application Ser. No. 07/621,126, filed on Nov. 30, 1990, and now abandoned.

BACKGROUND OF THE INVENTION

The present invention relates to continuous caster molds having an opposed pair of broad walls and an opposed pair of adjustably spaced narrow walls, and particularly to such a continuous caster mold and method of utilizing the mold for the production of relatively thin cast slabs.

In the continuous casting of steel, it is known to utilize molds having a pair of opposed broad walls and a pair of opposed narrow walls in which at least one of the narrow walls is adjustable for changing the width of the strand during the actual casting operation. Normally, the thickness of the strand being cast on currently existing casters is within the range of six to twelve inches (15 to 30 cm). For slabs of this thickness, the mold walls are essentially rectangular so that the broad walls are essentially equally spaced from each other at all elevations of the mold. Recently, work has been done to reduce the thickness of the slab being cast in order to bypass the roughing stands in a hot-strip mill. By casting a thinner slab, less reheating and, perhaps, no reheating may be required prior to charging into the strip mill. Thus, a thinner slab can eliminate the need for reheat furnaces and roughing stands as well as intermediate conditioning operations, thereby lowering the capital and production costs of making steel strip while increasing the yield.

The preferred thickness of a thin slab is 2 inches (5 cm) or less. Conventional continuous casters are generally adapted to cast slabs on the order of six to twelve inches (15 to 30 cm) in thickness, i.e., three to four times the thickness of a preferred thin slab. In downsizing a conventionally designed continuous casting mold to cast a thin slab, a difficulty is encountered in that molten metal introduced between the closely spaced, water cooled walls tends to solidify very quickly near the introduction point rather than uniformly. No practical means have been developed for introducing molten metal uniformly into a thin slab caster.

West German Patent No. 887,990, issued Aug. 27, 1953 to Rossi, describes a thin caster mold having a funnel-like upper portion adapted to receive liquid metal. The mold of 887,990 is not adjustable.

U.S. Pat. No. 4,635,702, issued Jan. 13, 1987 in the name of Kolakowski, et al., discloses a thin caster mold having straight-sided narrow walls adjustable to different slab widths. The broad walls of this mold have a funnel shape in their upper central portion adapted to receive liquid metal. A disadvantage of this mold is that the spacing to which the narrow walls may be adjusted is limited to only the length of part of the straight side portions of the outer ends of the broad walls and not into the funnel-shaped central portion thereof. A further disadvantage of this mold relates to the narrow sidewall adjustment mechanism. The narrow walls of this mold are extremely narrow, being on the order of 2 (5 cm) inches wide. These walls are movable in and out to vary the width of the slab being cast. The tilt angle of the narrow walls must also be adjustable since the optimum tilt angle is a function primarily of the slab width.

Other factors, such as the casting speed and tundish temperature, affect the preferred tilt angle at any given slab width. Due to the extremely narrow width of the side walls of Kolakowski et al., the width of the side wall adjustment mechanism is also limited. For use in adjusting the mold width and the narrow wall tilt angle, Kolakowski et al. employs a pair of thin threaded spindles attached to each narrow mold wall. Such spindles suffer from the lack of strength and vibration resistance. A further disadvantage of this design is that for each side of the mold, the narrow wall is tiltable only in its entirety, i.e., the top half and the bottom half are not independently adjustable.

It is known in heavier thickness caster molds to have the narrow walls tiltable about the central or mid-elevation axis of the narrow walls, for example, as shown in U.S. Pat. Nos. 3,926,244, Meier, et al; 4,505,321, Zeller; and 3,375,865, Boichenko, et al. Also, curved inner and outer surfaces on caster mold narrow walls are disclosed in U.S. Pat. No. 4,023,612, Jackson.

Moreover, these above-described prior molds are usually adapted to allow slabs of differing widths to be produced by movement of the narrow end walls. Such width changes are however, normally made only after casting is stopped or interrupted, thereby slowing the casting process and creating "transition castings", comprising a first portion of the newly or most recently cast slab and a second portion of the output slab which was cast just before casting was interrupted. This transition casting is usually disposed of as waste since it does not have uniform strength and other desirable properties. This casting interruption methodology is described in U.S. Pat. No. 4,245,692, issued on Jan. 20, 1981 in the name of Hargassner et al; and Japanese Patent Number 59-189047 which issued on Oct. 26, 1984.

It is a primary object of this invention to provide a continuous caster mold and method for casting relatively thin strands, the mold having narrow walls and the mold and method overcoming the disadvantages of the prior art.

SUMMARY OF THE INVENTION

According to one embodiment of this invention, a continuous caster mold is provided which has a pair of broad walls, a pair of narrow walls located and movably disposed between the broad walls, and means for adjusting the spacing and angle of tilt of the narrow walls. The distance between the broad walls at the upper portion of the mold is greater than the distance between these broad walls at the lower portion of the mold.

Moreover, in this first embodiment, the narrow mold walls are wider at the entry end of the mold than at the exit end and are adapted to sealingly engage the broad mold walls to prevent the leakage of molten metal therebetween. The inner surfaces of the broad mold walls proximate the exit end of the mold extend substantially parallel to the direction of casting. The sealing engagement of the inner surfaces of the broad walls in the upper portion of the mold with the inner surfaces of the narrow mold walls, act to form a cavity in the upper portion in which molten metal is received. Adjustment of the tilt angle of the lower portion of each narrow mold wall is independent from that of the upper portion. In another mold embodiment, the narrow walls are substantially similar, each having a smooth and continuous surface in contact with the received molten metal, an upper portion tilted by a first amount, and a lower portion tilted by a second and greater amount.

BRIEF DESCRIPTION OF THE DRAWINGS

The invention will be more clearly understood from the following description in conjunction with the accompanying drawings, wherein.

DESCRIPTION OF THE PREFERRED EMBODIMENT

Figure 1:
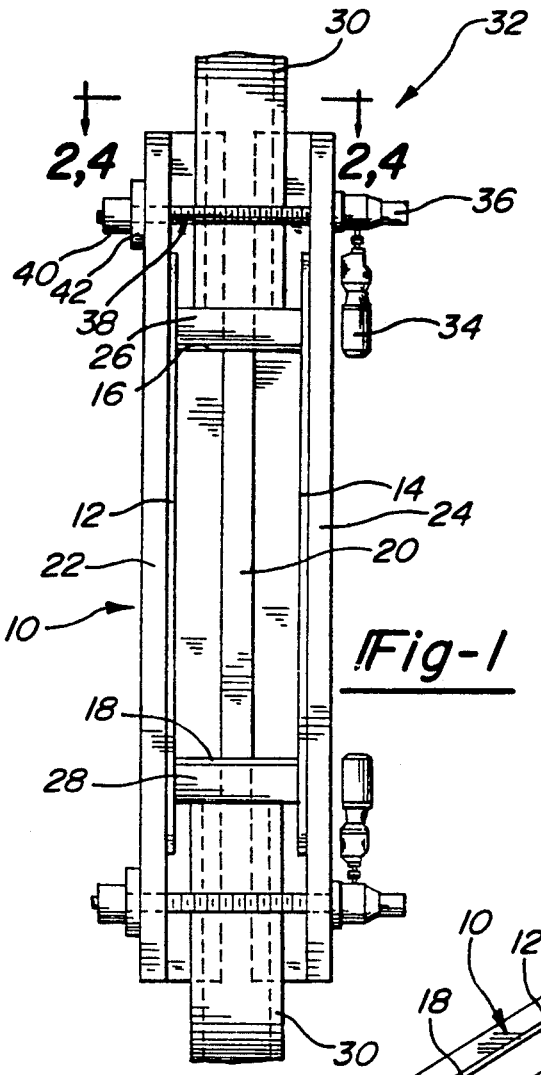
FIG. 1. is a top view of a continuous caster mold according to a first embodiment of the present invention.
Figure 2:
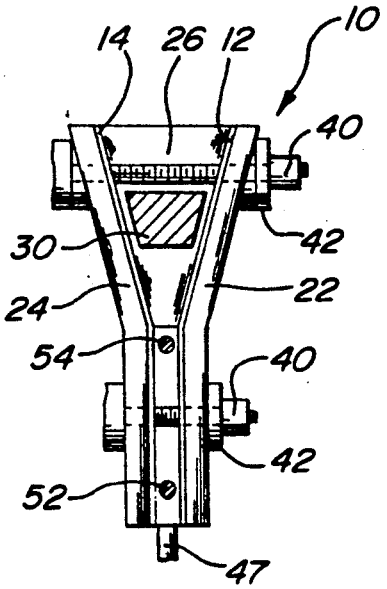
FIG. 2 is an end view of a continuous caster mold according to the first embodiment of the present invention, shown in the direction of view line 2—2 of FIG. 1.

FIG. 1 and FIG. 2 illustrate the thin slab continuous caster mold 10 according to a first embodiment of this invention. Mold 10 includes a pair of elongated opposed broad walls 12 and 14 and a pair of opposed narrow walls 16 arid 18 which together define mold cavity 20. The walls 12, 14, 16 and 18 are made of relatively thin copper or copper alloy plates which are secured to steel backup plates 22, 24, 26 and 28, respectively. Opposed broad walls 12 and 14 are substantially parallel to the casting direction, at the lower portion of the mold 48, but are not parallel at the top portion 46. Moreover, the distance between the broad walls 12 and 14 is greater at the upper portion of the mold 46 than at the lower portion 48. In fact, broad walls 12 and 14 each angularly diverge away from cavity 20 at the upper portion 46. Cooling water flows through cooling channels (not shown) in backup plates 22, 24, 26 and 28 and into contact with the back side of each end of mold walls 12, 14, 16 and 18. Water channels may also be cut into the back side of walls 12, 14, 16, 18.

The mold can be adjusted to cast slabs of different widths by moving one but preferably both of the narrow mold walls 16 and 18, (each of which, in the first embodiment has a generally Y-shaped cross sectional area) inwardly and outwardly with respect to mold cavity 20. Various mechanisms for moving the end walls are known in the art. The preferred mechanism for use with the mold of the invention employs a beam 30 attached to the upper portion of backing plate 26 or 28. A drive motor (not shown) moves the beam inwardly and outwardly with respect to the mold cavity 20, moving attached backup plates 26 and 28 and narrow mold walls 16 and 18.

Figure 3:
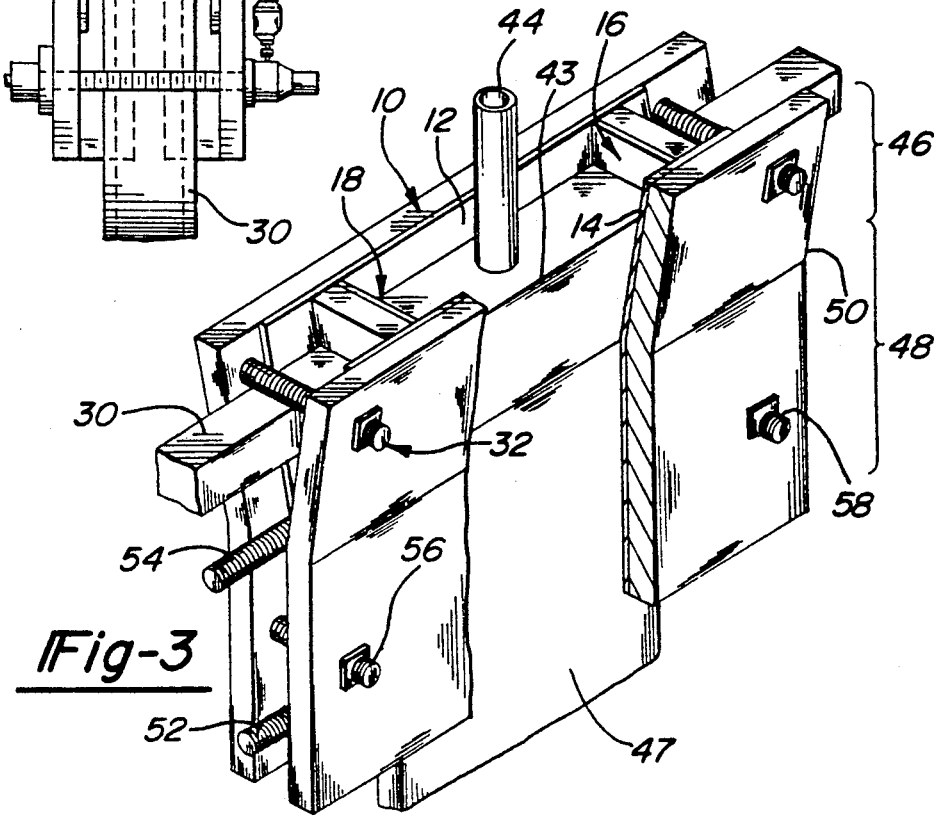
FIG. 3 is ail isometric view of a continuous caster mold according to the first embodiment of the present invention.
Figure 4:
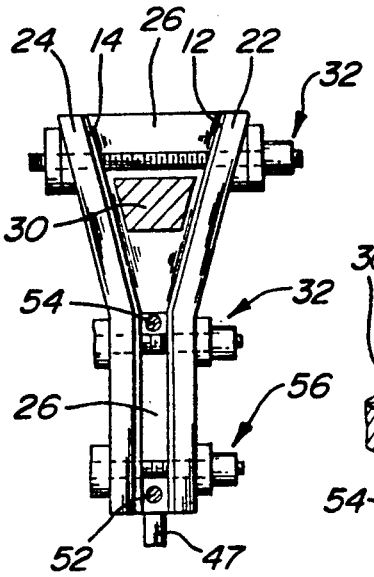
FIG. 4 is an end view of the continuous caster mold according to the first embodiment of the present invention shown in the direction of view line 4—4 of FIG. 1 and illustrating an alternate embodiment of the side wall clamping force mechanism.
Figure 5:
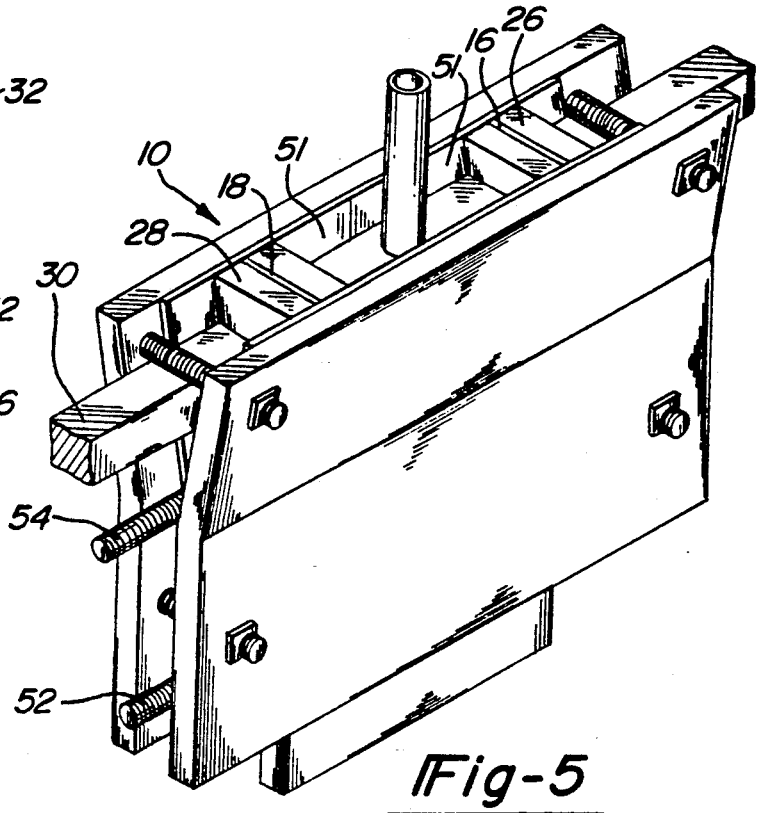
FIG. 5 is an isometric view of a solidification prevention means useful with the molds of the various embodiments of this invention.

In order to maintain the narrow walls in a fixed position during slab casting and to prevent leakage of molten metal from the mold, a clamping force is exerted on the narrow walls,16 and 18 between wide walls 12 and 14 through the use of a side wall clamping mechanism 32. The preferred side wall clamping mechanism is described in U.S. Pat. No. 4,487,249, issued Dec. 11, 1984, in the name of Wrhen. This mechanism, which is illustrated in FIG. 1, includes a gear motor 34 coupled to a screw jack 36 which drives a jack stem 38. A spring assembly 40 is provided for biasing wide mold wall 12 against narrow mold walls 16 and 18. A load cell 42 is mounted on jack stem 38 between spring assembly 40 and backup plate 22 of mold wall 12. The motor 34 and jack screw 36 drive jack stem 38 back and forth so as to vary the degree of compression of spring 40. Load cell 42 measures the force exerted on backup plate, 22 and 24 and provides an output signal proportional thereto to regulate the degree of clamping force exerted by wide walls 12 and 14 on narrow walls 16 and 18, allowing for control of the clamping force by regulation of motor 34. As illustrated in FIGS. 2 and 3, preferably two clamping force mechanisms are mounted on each end of the mold with one mechanism at the level of the meniscus 43 and the other mechanism mounted about one-third of the distance from the bottom of the mold to the meniscus. For the mold design of the invention, an alternate embodiment would employ three clamping force mechanisms as illustrated in FIG. 4.

As is observable in FIG. 3, molten metal from a conventional tundish or ladle (neither of which is shown) enters the top or entry end 46 of mold 10 through refractory pouring tube 44, the tip of which is submerged beneath the surface of the molten metal. In the preferred embodiment, the cross-sectional area of the upper portion 46 of the mold is enlarged to permit the upper portion to receive pouring tube 44 through the positioning of the substantially planar broad mold walls 12 and 14, at an angle with respect to the casting direction to form a cavity 20 (FIG. 1). This angle, which is dependent on the particular product being cast, will generally be about 8 to 14 degrees. While the inner surfaces of broad walls 12 and 14 are about 6 inches apart at the meniscus 43, the inner surfaces of broad walls 12 and 14 are only about 2 inches (5 cm) apart in the bottom portion 48 of mold 10, and the slab 47 which exits from the bottom or exit end of the mold is on the order of 2 inches in thickness. While some solidification occurs in the upper portion of the mold 46, the thick skin which must be formed before the slab can exit the bottom of the mold, and is preferably formed only in the bottom portion 48 of the mold. Should a thick skin form in the end sections of the upper portion of the mold 46, the slab could not be pulled past transition point 50 without, most probably, damaging the mold walls and/or producing a severely damaged slab edge surface. Therefore, solidification in the upper portion of the mold 46 is prevented, particularly in the end portions, through the addition of mold coatings, such as nickel or other thermal insulation about the inside surfaces of end walls 16 and 18 and broad faces 12 and 14. Mechanisms for adjusting the tilt angle of the entire narrow mold wall simultaneously are known in the art. One such mechanism is described in U.S. Pat. No. 4,679,614, issued Jul. 14, 1987, in the name of Grove.

The unique design of the mold according to the first embodiment of this invention requires that the taper of the lower portion of the narrow walls 16 and 18 be adjustable independently from that of the upper portion. Adjustment of the tilt angle of the upper portion creates difficulties with maintaining the seal between the narrow walls 16 and 18 and the wide walls 12 and 14. Also, the slight amount of solidification in the upper portion of the mold creates very little shrinkage of the cross-sectional area of the partially solidified slab, requiring very little taper adjustment during casting. Therefore, it is desirable to set this upper portion tilt at the beginning of the cast and to maintain it at that angle unless a width change is required. However, optimum casting practice may require the tilt angle of the narrow walls in the lower portion of the mold to be adjusted several times while casting at a specific slab width. Also, the lower portion of narrow wall must be adjusted when the slab width is changed.

Figure 8:
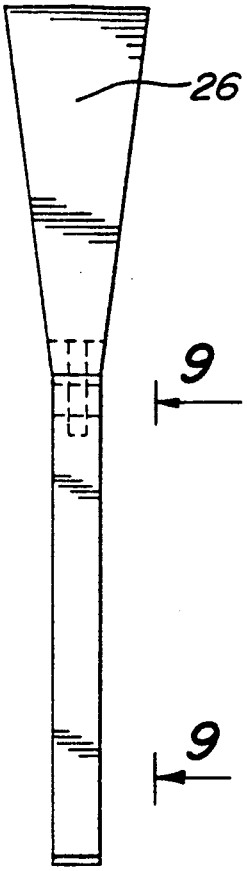
FIG. 8 is an end view of a continuous caster mold according to the first embodiment of this invention, including a hinge effective to pivotally connect the upper and lower backup plates and corresponding upper and lower mold walls.
Figure 9:
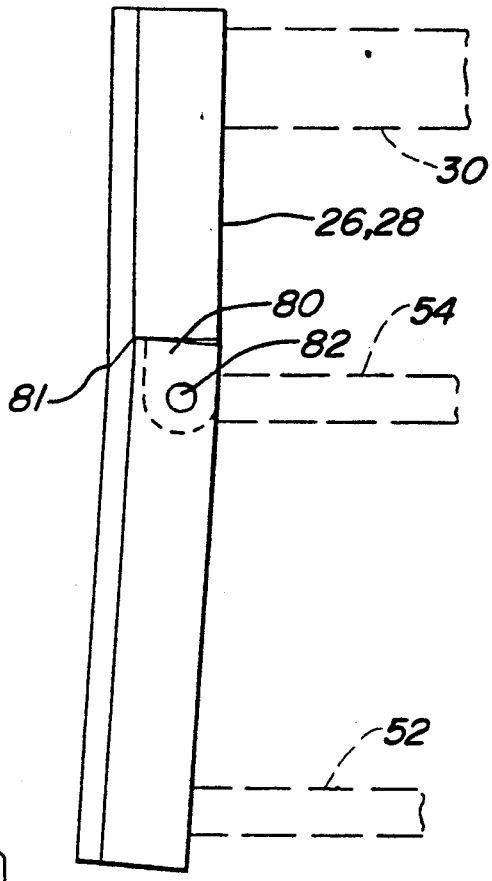
FIG. 9 is a side view of the continuous caster mold of the first embodiment of this invention, taken in the direction of arrow 9 in FIG. 8.

FIG. 3 illustrates a preferred embodiment of the tilt angle adjustment mechanism. The narrow walls 16 and 18 are movable in and out of mold cavity 20 for changing the width of the slab being cast by sliding beams 30, and narrow walls 16 and 18 are maintained in position in the upper portion 46 of mold 10 through sidewall clamping mechanism 32. Each backup plate 26, 28 includes an upper piece, positioned within the upper portion 46 and articulated at transition point 50 for limited movement with respect to a lower piece, positioned within the lower mold portion 48. Various hinge mechanisms can be used for pivotally connecting the upper and lower backup plate portions and the respectively attached and cot-responding upper and lower portions of mold walls 16 and 18. One such hinge mechanism is shown in FIGS. 8 and 9.

Specifically, in this embodiment, each backup plate 26, 28 has a flange portion 80 which is pivotally coupled to one of two horizontal members 82. Each of the members 82 extends through and is coupled to one of the plates 26 and 28 within the lower portion 48 of the mold. Flange 80 and member 82 cooperate to allow the upper backplate portion, disposed within upper mold portion 46, to be tilted independently from lower backplate portion 48, associated with each of the plates 26 and 28.

Moreover, as shown, a threaded spindle 52 is attached to each of backup plates 26 and 28 of narrow mold walls 16 and 18 proximate the slab exit end of the mold. The attachment of each threaded spindle 52 to each of the backup plates 26 and 28 is such as to allow each of the spindles 52 to remain in contact with their associated backup plate 26 or 28 as these backup plates 26 and 28 are moved thereby. Such attachment will be understood by one skilled in the art. Threaded spindles 52 are movable in and out of mold cavity 20 through a motorized mechanism (not shown). A pivot rod 54 is attached to the backup plates 26 and 28 proximate transition point 50. The attachment of each of the pivot rods 54 to each of the backup plates 26 and 28 is such as to allow rods 54 to remain in contact with their associated backup plates 26 or 28 as the backup plates 26 and 28 are moved thereby. Such attachment will be understood by one skilled in the art and is adapted to adjust the tilt angle of walls 16 and 18 in upper portion 46. The pivot rod is held in a fixed position while threaded spindle 52 is rotated to move the portion of the narrow mold wall near exit end of mold 10 inwardly and outwardly to adjust the tilt angle of narrow mold walls 16 and 18 in lower portion 48 of mold 10. While the above-described mechanism is currently preferred, alternate mechanisms which permit independent tilt angle adjustment of the lower portion of the narrow mold walls are contemplated.

In operation of the continuous casting mold of the first embodiment of this invention, a slab width is selected, and the initial tilt angles of the narrow mold walls in the upper and lower portions of the mold are preset, as is the clamping force on the narrow mold walls. During casting, should the taper angle require adjustment, the clamping force being exerted by the clamping mechanisms in the lower portion of the mold 48 is first checked to ensure that the clamping force is sufficiently low that narrow mold walls 16 and 18 can be moved without damaging the soft copper of broad mold walls 12 and 14. Rotatable spindle 52 is then rotated by motorized mechanism (not shown) to move the bottom portion of the narrow mold wall in or out. The force on the side walls in the lower portion of the mold 48 is then increased or decreased, if necessary, through clamping mechanisms in positions 56 and 58 to prevent leakage of molten metal between the wide and narrow mold walls and prevent mold damage.

Should a width change be required during casting, a corresponding tilt angle change will also be required. If a narrower slab is to be cast, the narrow mold walls 16 and 18 are moved inwardly first and then the tilt angle is adjusted. If a wider slab is to be cast, the tilt angle is first adjusted to an angle which is exaggerated with respect to the final tilt angle, i.e., the lower portion of the mold walls is urged inwardly to achieve a tilt angle greater than the final tilt angle. The mold walls 16 and 18 are then moved outwardly to the desired positions. The tilt angle of the lower portion of the narrow mold walls is then adjusted to the desired angle. It should be realized that no interruption or intermission of casting is necessary during these width changes.

Figure 6:
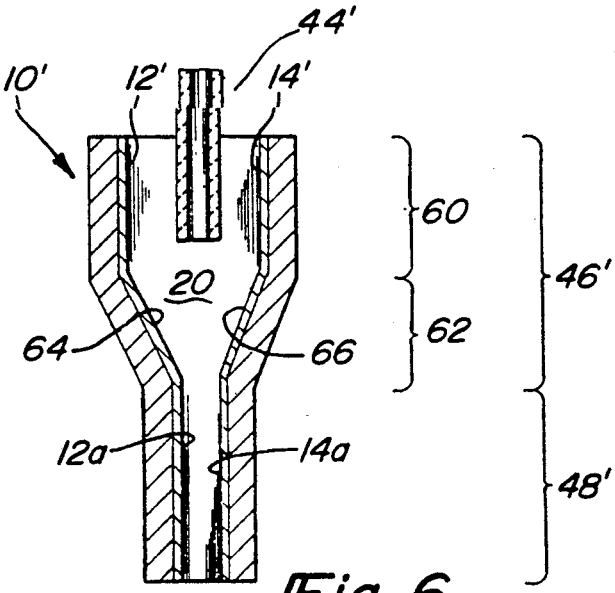
FIG. 6 is a side sectional view of a first alternate embodiment of a mold according to the invention.

While the preferred configuration of the upper portion 46 of the mold 10 is illustrated in FIGS. 1 and 2, several other configurations which are adapted to receive a pouring tube and to feed into the reduced cross section lower portion 48 are expected to work well. In FIG. 6, there is depicted a cross section of an alternate embodiment of a thin slab casting mold 10' in which the upper portion 46' of the mold 10' comprises two sections. The entry section 60 of upper portion 46' is adapted to receive a pouring tube 44'. This section 60 is essentially the same as the top section of a conventional continuous casting mold, having parallel broad walls 12' and 14'. Joining entry section 60 to lower portion 48' is a transition section 62. This section preferably includes angled broad wall portions 64 and 66 joining broad walls 12' and 14' of entry section 60 with the more closely spaced parallel broad walls **12*a* and 14*a* of lower portion 48' of mold 10'. The preferred angle of the broad walls 12' and 14' is dependent on the product being cast while the preferred range of this angle is about 8 to 14 degrees. This design provides increased volume in the portion of the mold adapted to receive molten metal. However, this mold 10' is more difficult to fabricate than mold 10 of FIG. 1**, making it more expensive.

Figure 7:
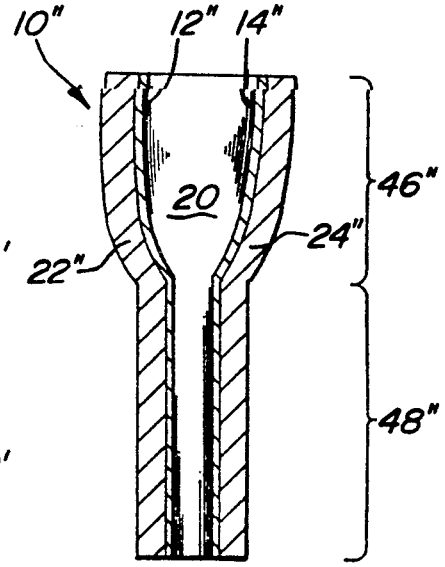
FIG. 7 is a side sectional view of a second alternate embodiment of a mold according to the invention.

A second alternative mold design 10'' is depicted in FIG. 7. As with the mold 10 of FIG. 1, the broad walls 12'' and 14'' of upper portion 46'' are formed in one piece. However, broad mold walls 12'' and 14'' do not taper linearly from the top of upper portion 46'' to the reduced area lower portion 48'' but instead are curved as depicted in FIG. 7. The curved shape can be elliptical, hyperbolic, or other geometric pattern providing for introduction of molten metal. This curved wall design provides slightly more volume in upper portion 46'' for receiving molten metal but it is more difficult to fabricate, requiring bending or machining of the backup plates 22'' and 24'' and of the thin copper or copper alloy inner walls 12'' and 14''.

In yet a third alternate mold design 10'', the hinge mechanism shown in FIG. 8 and 9 is eliminated, in order to improve reliability by eliminating the moving flange 80, thereby simplifying the overall design while eliminating mold wall crevices into which molten metal may seep and solidify. One such crevice 81 has been found to occur between the upper and lower portions of the mold walls 16, 18 that one in contact with the received molten metal and increases which as flange 80 pivots in a clockwise manner upon pin 82 (See FIG. 9). This solidified metal causes frictional damage to the walls 16, 18 and plates 26, 28 as one wall portion is moved or pivoted with respect to the other. Moreover, this solidified metal also causes damage to flange 80.

Figure 10:
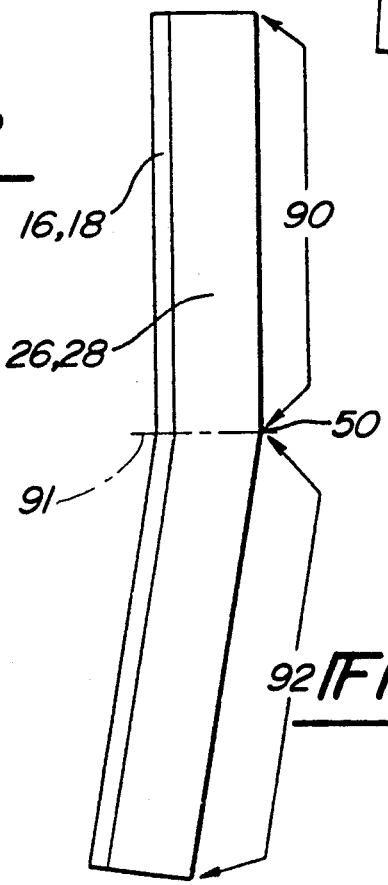
FIG. 10 is a side view of an end wall of a continuous caster mold, made in accordance with a third alternate embodiment of this invention.

As shown in FIG. 10, this hinge mechanism is eliminated by forming each narrow mold wall such that it provides a flat, smooth, unbroken, and continuous face or surface which is adapted to be in continual contact with the molten metal contained in the mold and slab. Moreover, walls 16 and 18 each include a top portion 90 which forms a first angle with respect to a horizontal axis 91 passing through the center of the wall, and a bottom portion 92 which forms a second angle with respect to this horizontal axis 91. In this manner, overall mold reliability is improved since mold walls 16 and 18 present a continuous smooth surface to the molten metal continued in mold 20 and have substantially no crevices or fissures into which the molten metal may seep and harden.

The independently angled top and bottom portions 90 and 92 also allow walls 16 and 18 to be tilted, without casting interruption, and allow for substantially continuous contact to be maintained between the mold walls 16 and 18 and the contained molten metal and slab. Moreover, in the preferred embodiment of this invention, the second angle (associated with the bottom portion 92) is greater than the first angle (associated with the top portion 90) in order to account for shrinkage as well as required mold width changes. In this third embodiment, spindle 52 is adapted to dependently impart a pivoting force to the lower or bottom portion 92 with respect to the upper or top portion 90, while rod 54 is adapted to pivot wall 16, 18 by independently imparting a pivoting force to the upper portion 90 with respect to the lower or bottom portion 92. Moreover, it should be realized that this third embodiment differs from the first embodiment only in its use of endwalls illustrated in FIG. 10. These endwalls may have a selectable cross sectional area, including those types illustrated in and described with respect to FIGS. 2, 6, and 7. The only requirement being that the endwalls provided a continuous, flat, and smooth surface to the contained molten metal and slab and that the end walls each have a top portion independently angled or tilted with respect to a second or bottom portion.

Other embodiments which provide for acceptance of molten metal in an upper portion of a continuous casting mold having a symmetrical cross section in all elevations and feeding into a reduced cross section lower portion have not been described herein but are contemplated by the invention.

I claim:

1. A method for continuously casting a thin slab comprising the steps of:

providing a mold having an upper portion proximate an entry end for receiving molten metal therein and a lower portion proximate an exit end for emitting along a casting direction a cast slab therefrom, said mold further having:

a pair of broad mold walls, each having a first portion defining a first angle with respect to said casting direction and a second portion defining a second angle with respect to said casting direction;

first and second narrow walls, each of said narrow walls being movably disposed between said pair of broad mold walls and having a flat-smooth and continuous surface in contact with said received molten metal, an upper portion forming a first angle with respect to a horizontal axis passing through the center of said wall, and a lower portion forming a second angle with respect to said horizontal axis, said second angle being greater than said first angle;

first moving means, coupled to said first and to said second narrow walls, for moving said first narrow wall between said pair of broad walls and for moving said second narrow wall between said pair of broad walls;

first pivoting means, coupled to said first narrow wall, for imparting a pivoting force to said upper portion of said first narrow wall with respect to said lower portion of said first narrow wall, thereby pivoting said first narrow wall into the interior of said mold thereby causing said upper portion to be in contact with said received molten metal;

second pivoting means, coupled to said second narrow wall, for imparting a pivot force to said upper portion of said second narrow wall with respect to said lower portion of said second narrow wall, thereby pivoting said second narrow wall into the interior of said mold thereby causing said lower portion to be in contact with said received molten metal; and second moving means coupled to said pair of broad mold walls for moving, in response to said movement of said first and said second narrow walls, said pair of broad mold walls towards and away from said first and said second narrow walls in order to cause said broad mold walls to sealingly engage said first and second narrow walls in order to prevent leakage of molten metal from said mold, said method further comprising the steps of:

selecting a first slab width;

positioning said pair of narrow walls at a first position corresponding to said first selected slab width;

continually pouring molten metal into said upper portion of said mold;

tilting said upper portions of said narrow walls into said mold by a first amount, effective to ensure that said upper portions of said narrow walls each maintain contact with said received molten metal as said slab of said first selected width is cast;

tilting said lower portions of said narrow walls by a second amount, greater than said first amount, into said mold effective to ensure that said lower portion maintain contact with said received molten metal as said slab of said first selected width is cast;

selecting a second slab width;

moving said pair of narrow walls to a second position corresponding to said second selected slab width as said molten metal is continually poured into said mold;

tilting said upper portions of said narrow walls into said mold by a third amount, effective to ensure that said upper portions of said narrow walls each maintain contact with said received molten metal as said slab of said second selected width is cast; and tilting said lower portions of said narrow walls into said mold by a fourth amount which is greater than said third amount, effective to ensure that said lower portions maintain contact with said received molten metal as said slab of said second selected width is cast.

* * * * *

UNITED STATES PATENT AND TRADEMARK OFFICE

CERTIFICATE OF CORRECTION

PATENT NO. : 5,279,354

DATED : January 18, 1994

INVENTOR(S) : Grove

It is certified that error appears in the above-identified patent and that said Letters Patent is hereby corrected as shown below:

At column 9, line 6, "portion" should read --portions--.

Signed and Sealed this

Thirteenth Day of September, 1994

*Attest:*

*Attesting Officer*

BRUCE LEHMAN

*Commissioner of Patents and Trademarks*